US008228000B2

(12) United States Patent
Rudolph

(10) Patent No.: US 8,228,000 B2
(45) Date of Patent: Jul. 24, 2012

(54) CIRCUIT ARRANGEMENT FOR OPERATING A LOW-PRESSURE GAS DISCHARGE LAMP AND CORRESPONDING METHOD

(75) Inventor: Bernd Rudolph, Forstern (DE)

(73) Assignee: OSRAM AG, Munich (DE)

( * ) Notice: Subject to any disclaimer, the term of this patent is extended or adjusted under 35 U.S.C. 154(b) by 305 days.

(21) Appl. No.: 12/777,309

(22) Filed: May 11, 2010

(65) Prior Publication Data

US 2010/0289419 A1 Nov. 18, 2010

(30) Foreign Application Priority Data

May 12, 2009 (DE) ..... 10 2009 020 849

(51) Int. Cl.
*H05B 41/16* (2006.01)
*H05B 41/24* (2006.01)

(52) U.S. Cl. ..... 315/274; 315/94; 315/105; 315/107; 315/117

(58) Field of Classification Search ..... 315/94, 315/105–107, 112, 115–117, 224–226, 274, 315/291, 302, 307–309, DIG. 5, DIG. 7
See application file for complete search history.

(56) References Cited

U.S. PATENT DOCUMENTS

| | | | | |
|---|---|---|---|---|
| 5,854,538 | A | 12/1998 | Krummel | |
| 6,433,490 | B2 * | 8/2002 | Koch et al. | 315/224 |
| 7,432,662 | B2 * | 10/2008 | Busse | 315/209 T |
| 7,439,680 | B2 * | 10/2008 | Gao et al. | 315/209 R |
| 2006/0267519 | A1 | 11/2006 | Gao et al. | |

FOREIGN PATENT DOCUMENTS

EP 0748146 B1 8/2001

* cited by examiner

*Primary Examiner* — Anh Tran

(57) ABSTRACT

A circuit arrangement is provided, which may include an input; an output; an inverter, configured to provide an AC supply voltage from a DC supply voltage; a control device configured to drive the inverter, the control device being configured to initiate a preheating phase once a preheating criterion has been met; a resonant circuit having a resonant inductor and having a resonant capacitor; and a transformer configured to preheat electrodes of a gas discharge lamp; wherein the primary winding of the transformer is connected in series with the resonant capacitor and is connected directly to the reference potential of the control device, and an electrical switch is coupled in parallel with the primary winding of the transformer, which switch has a control connection, which is coupled to the control device being configured to transfer the electrical switch into its electrically conducting switching state once the starting criterion has been met.

8 Claims, 1 Drawing Sheet

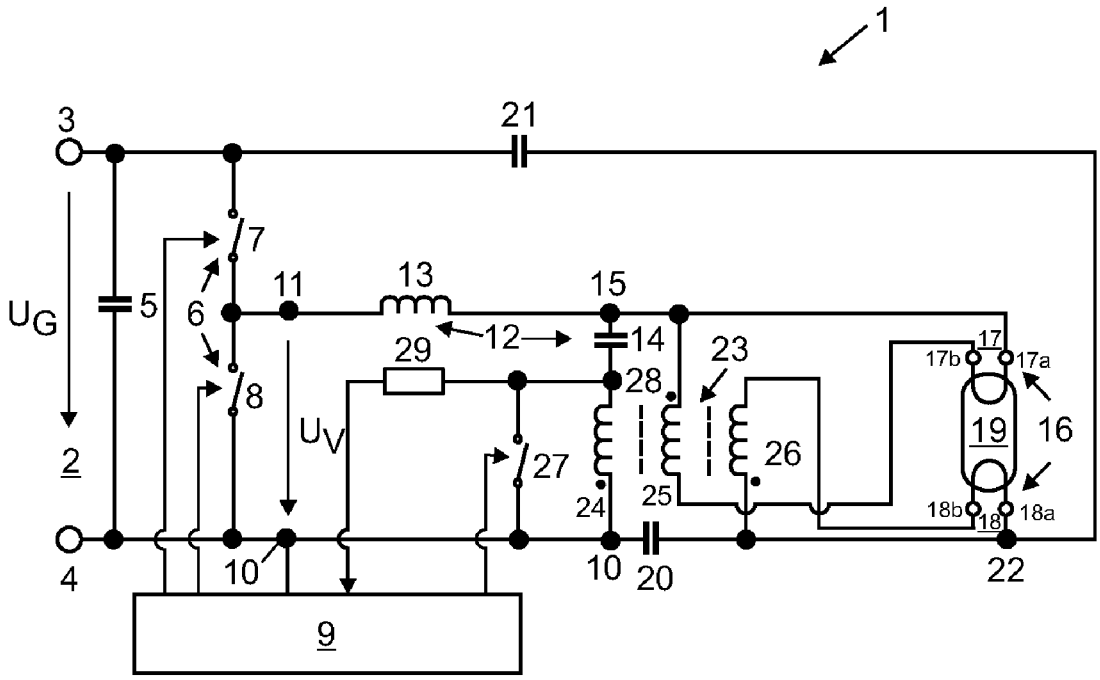
1
3
21
7
6
5
$U_G$
11
13
15
12
14
29
28
23
17
17b
17a
8
$U_V$
2
27
26
19
16
24
25
18b
18
18a
4
10
10
20
22
9

CIRCUIT ARRANGEMENT FOR OPERATING A LOW-PRESSURE GAS DISCHARGE LAMP AND CORRESPONDING METHOD

CROSS-REFERENCE TO RELATED APPLICATION

This application claims priority to German Patent Application Serial No. 10 2009 020 849.6, which was filed May 12, 2009, and is incorporated herein by reference in its entirety.

TECHNICAL FIELD

Various embodiments relate generally to a circuit arrangement for operating a low-pressure gas discharge lamp and a corresponding method.

BACKGROUND

Various embodiments are based on a circuit arrangement as is described in the document EP 0 748 146 A1. In the circuit arrangement disclosed therein, an inverter provides an AC supply voltage for a low-pressure gas discharge lamp (fluorescent lamp). A resonant inductor is coupled to the inverter. A resonant capacitor is coupled in parallel with the low-pressure gas discharge lamp. All of the operational functions of the gas discharge lamp are controlled via the inverter. Once the circuit arrangement has been brought into operation (this takes place by applying an AC system voltage to a switched mode power supply coupled to the inverter), the inverter is operated at a frequency which is not only above the open-circuit resonant frequency of the resonant circuit (resonant inductor and resonant capacitor), but also above a starting frequency, during a preheating phase for gentle starting of the gas discharge lamp. During this preheating phase, a preheating current flows via the electrodes of the gas discharge lamp. This current is intended to heat the electrodes to emission temperature. Since the frequency of the AC supply voltage during the preheating phase is greater than the starting frequency of the gas discharge lamp, premature starting of the gas discharge lamp is prevented. That is to say that, above the resonant frequency of the resonant circuit, the amplitude of the voltage across the resonant capacitor is indirectly proportional to the frequency.

The document US 2006/0267519 A1 likewise describes a circuit arrangement for operating a low-pressure gas discharge lamp. Said document deals with the problem of protecting a person who is at the ground reference potential and who is touching the gas discharge lamp from an electric shock. This document takes the approach of connecting the reference potential of the gas discharge lamp to the reference potential of the inverter via a parallel circuit comprising a switch and a capacitor. The switch is only closed when the gas discharge lamp has started correctly. Otherwise, the switch remains open, with the result that the connection of the gas discharge lamp is largely decoupled at a low frequency from the reference potential of the inverter. The capacitor which is coupled in parallel with the switch is necessary for ensuring this decoupling between the connection of the gas discharge lamp and the reference potential of the inverter.

SUMMARY OF THE INVENTION

In various embodiments, a circuit arrangement is provided, which may include an input; an output; an inverter, configured to provide an AC supply voltage from a DC supply voltage; a control device configured to drive the inverter, the control device being configured to initiate a preheating phase once a preheating criterion has been met; a resonant circuit having a resonant inductor and having a resonant capacitor; and a transformer configured to preheat electrodes of a gas discharge lamp; wherein the primary winding of the transformer is connected in series with the resonant capacitor and is connected directly to the reference potential of the control device, and an electrical switch is coupled in parallel with the primary winding of the transformer, which switch has a control connection, which is coupled to the control device being configured to transfer the electrical switch into its electrically conducting switching state once the starting criterion has been met.

BRIEF DESCRIPTION OF THE DRAWINGS

Further features of various embodiments are given in the claims, the FIGURE and the description relating to the FIGURE. The features and combinations of features mentioned above in the description and the features and combinations of features mentioned below in the description relating to the FIGURE and/or shown in the FIGURE alone can be used not only in the respectively specified combination, but also in other combinations or on their own without leaving the scope of the invention. In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawing, in which the single FIGURE shows a schematic illustration of a circuit arrangement in accordance with an embodiment.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide a circuit arrangement for operating at least one low-pressure gas discharge lamp, with an input with a first and a second input connection for applying a DC supply voltage, with an output with a first and a second output connection pair for connecting the at least one low-pressure gas discharge lamp, with an inverter, which is coupled to the first and the second input connection, for providing an AC supply voltage from the DC supply voltage, with a control device for driving the inverter and for thereby controlling the frequency of the AC supply voltage, the control device being designed to initiate a preheating phase once a predetermined preheating criterion has been met, in which preheating phase the inverter is operated at a preheating frequency, and to set the frequency of the AC supply voltage to a starting frequency once a predetermined starting criterion has been met, with a resonant circuit with a resonant inductor, whose first connection is coupled to the inverter, and whose second connection is coupled to a resonant pole, and with a resonant capacitor, which is coupled between the resonant pole and the reference potential of the control device, and with a transformer for preheating electrodes of the low-pressure gas discharge lamp, which transformer includes a primary winding, a first secondary winding, which is coupled to the first output connection pair, and a second secondary winding, which is coupled to the second output connection pair. In addition, the invention relates to a method for operating a low-pressure gas discharge lamp using such a circuit arrangement.

For the preheating of the electrodes of the gas discharge lamp, in contrast to the abovementioned document EP 0 748 146 A1, a transformer may be used whose primary winding may be connected to the output of the inverter via a coupling capacitor. Secondly, the primary winding can be coupled to the reference potential via a semiconductor switch. Two secondary windings may be provided for the transformer, with each of these secondary windings being coupled to an electrode of the gas discharge lamp. The electrodes can be preheated in this way.

Accordingly, in contrast to document EP 0 748 146 A1, a semiconductor switch may be provided for the primary winding, which semiconductor switch may be designed for operation at high voltages. A transformer is likewise provided which is operated approximately as a voltage transformer. In addition, a clamping diode may be provided, via which the voltage across the preheating switch can be limited to the supply voltage of the inverter. In various embodiments such reliable preheating of the electrodes as is ensured in the document EP 0 748 146 A1 can be achieved more easily and less expensively.

Various embodiments provide a solution, e.g. starting from the subject matter in accordance with document EP 0 748 146 A1, as to how a circuit arrangement of the generic type mentioned at the outset can be provided with a particularly favorable design.

In various embodiments, the primary winding of the transformer is connected in series with the resonant capacitor and is connected directly to the reference potential of the control device, and an electrical switch is coupled in parallel with the primary winding of the transformer. The electrical switch has a control connection, which is coupled to the control device. The control device is designed to transfer the electrical switch into its electrically conducting switching state once the starting criterion has been met.

That is to say that the effect according to various embodiments may be achieved by virtue of the fact that the primary winding of the transformer is firstly coupled in series with the resonant capacitor and is secondly connected directly to the reference potential of the control device, and also by the bridging of the primary winding when the low-pressure gas discharge lamp is started. In other words, a basic concept of various embodiments may consist in allowing the current flowing via the resonant capacitor, which is connected in parallel with the gas discharge lamp, to also flow via the primary winding, which is connected to the reference potential of the control device, during the preheating phase and in short-circuiting said primary winding after the preheating phase on the primary side with the reference potential of the control device with the aid of the electrical switch.

The circuit arrangement according to various embodiments firstly has the advantage over the subject matter according to document EP 0 748 146 A1 that it manages without any additional coupling capacitor for the primary winding of the transformer; the function of the coupling capacitor is in this case performed by the resonant capacitor. Secondly, the circuit arrangement according to various embodiments also manages without a clamping diode, as is used in the prior art; that is to say that the primary winding is short-circuited by means of the electrical switch when the gas discharge lamp is started. A further advantage of the circuit arrangement according to various embodiments over the subject matter according to document EP 0 748 146 A1 can be considered to be the fact that an inexpensive low-voltage switch (inter alia with a voltage of less than 100 volts) can be used for bridging the primary winding. In the prior art, the switch would have to be designed for operation at high voltages, such as the voltage drops across the primary winding, however (typically 600 volts).

The circuit arrangement according to various embodiments also has advantages over the subject matter according to document US 2006/0267519 A1 as regards the number of components used and therefore as regards costs. In order to achieve the technical object specified in said document, a capacitor would have to be inserted between the primary winding and the reference potential. The switch used there for bridging the primary winding and the capacitor would also have to be able to withstand high voltages, which is associated with additional costs in comparison with a low-voltage switch.

In the subject matter according to document US 2006/0267519 A1, a coupling capacitor would also have to be connected between the inverter and the resonant inductor, as dictated by the technical object specified therein.

In contrast, the coupling capacitor with the circuit arrangement according to various embodiments can be coupled between the second connection pair of the output and the reference potential of the control device (i.e. can be connected to the "low side" of the gas discharge lamp). In this way, the coupling capacitor can also be designed to be symmetrical, and the current loading of an intermediate circuit capacitor, which is coupled in parallel with the input, and the voltage of the gas discharge lamp to ground can be reduced.

A further advantage of the circuit arrangement according to various embodiments should not be forgotten, namely that a voltage drop across the primary winding can be detected by the control device. This is made possible by virtue of the fact that the primary winding of the transformer, in contrast to the subject matter according to document US 2006/0267519 A1, is coupled directly to the reference potential of the control device. The detection of the voltage drop across the primary winding makes it possible to be able to draw conclusions on operating states prevailing at the secondary windings and therefore at the output of the circuit arrangement at any one instant. By virtue of the evaluation of this voltage, it is possible to identify an operating state in which the connections of an individual connection pair are short-circuited or else in which there is an open circuit between these connections, namely, for example, once the gas discharge lamp has been unscrewed or once a filament has burnt through. If, for example, an impermissible operating state is identified at the output of the circuit arrangement, the control device can switch off the inverter and therefore the AC supply voltage.

It has proven to be particularly advantageous if the electrical switch is a bidirectionally blocking or conducting semiconductor switch. For example, the electrical switch can be a symmetrically blocking or conducting MOSFET. Such MOSFETs in which the parasitic diode is no longer provided have recently been available on the market. Firstly, it is possible to achieve much shorter switching times with a MOSFET than with a conventional relay; secondly MOSFETs are less expensive.

As has already been mentioned, the circuit arrangement may have the advantage that the voltage drop across the primary winding of the transformer can be measured, as a result of which operating states prevailing at the output can be identified. One embodiment provides for the control device to be coupled to a detection pole, which is arranged between the winding and the resonant capacitor, and to be designed for detecting the voltage drop across the primary winding. In this case, the following relationship is utilized: if the impedance of a circuit containing the secondary winding changes, the effective impedance at the primary winding of the transformer also changes. The change in the impedance on the secondary side can thus be identified directly by evaluating the voltage across the primary winding. If the voltage drop across the primary winding is in an impermissible value range, the control device can disconnect the AC supply voltage. This can be used, for example, in the following scenario: an operator switches on a mains switch in order to switch on the gas discharge lamp. A switched mode power supply provides a DC supply voltage for the circuit arrangement from the AC voltage of the power supply system. Even before the initiation of the preheating phase, in which the electrodes of the gas discharge lamp are preheated, the control device drives the inverter in such a way that very low currents flow via the primary winding. The control device now checks whether the electrical voltage drop across the primary winding is in a permissible value range, i.e. whether the gas discharge lamp is connected correctly to the output and the lamp electrodes are operational or not. If the control device identifies, for example, that there is no gas discharge lamp connected to the circuit arrangement, the control device switches off the inverter.

One embodiment provides for the control device to be designed to drive the inverter prior to the initiation of the preheating phase and to detect the voltage drop across the primary winding during this driving, the preheating criterion including the fact that this voltage is in a predetermined value range. That is to say that the preheating phase is only initiated by the control device when the gas discharge lamp is connected correctly to the circuit arrangement. This prevents the preheating phase from being initiated when, for example, there is no gas discharge lamp connected and prevents an operator from coming into contact with a high voltage. Thus, the circuit arrangement also does not require the high-voltage resistors, coupling capacitors or diodes at the secondary windings of the preheating transformer which are otherwise used for identifying the presence of the lamp electrodes.

The control device can also detect the voltage drop across the primary winding during the preheating phase. In this case, the starting criterion includes the fact that this voltage is in a predetermined value range. The control device can therefore also identify an impermissible operating state at the output of the circuit arrangement during the preheating phase and possibly interrupt the preheating phase. This may be the case, for example, when the gas discharge lamp is unscrewed or a filament of the lamp burns through during the preheating phase. This embodiment can be used, for example, in the following sequence: an operator switches on a mains switch, as a result of which a DC supply voltage is provided at the input of the circuit arrangement. The control device initiates the preheating phase, namely with corresponding driving of the inverter. During this preheating phase, the control device monitors the voltage drop across the primary winding. At the beginning of the preheating phase, this voltage is in the predetermined permissible value range, with the result that the preheating phase is continued. During the preheating phase, a filament of the gas discharge lamp burns through and an open circuit is produced between the connections of the corresponding connection pair. This open circuit is identified by the control device, namely by virtue of the fact that the voltage across the primary winding is outside the predetermined permissible value range. Directly after identification of the open circuit, the control device switches off the inverter.

In addition or as an alternative, the starting criterion can include the fact that a predetermined time interval has elapsed once the preheating phase has been initiated. Then, it is ensured that the electrodes of the gas discharge lamp are preheated for the predetermined time interval and the gas discharge lamp is started gently.

A method according to various embodiments is designed for operating at least one low-pressure gas discharge lamp using a circuit arrangement of the generic type mentioned at the outset. In the method, an electrical current flowing via the resonant capacitor is also conducted via the primary winding of the transformer during the preheating phase, the primary winding being coupled directly to the reference potential of the control device. Once the starting criterion has been met, an electrical switch is closed and the primary winding is thereby bridged.

The embodiments proposed with reference to the circuit arrangement and the advantages thereof apply correspondingly to the method according to various embodiments.

A circuit arrangement 1 illustrated in the FIGURE includes an input 2 with a first and a second input connection 3, 4. A DC supply voltage $U_G$ can be provided at the input 2, namely by means of a switched mode power supply from an AC voltage of a power supply system. An intermediate circuit capacitor 5, at which the DC supply voltage $U_G$ is present, is connected in parallel with the input 2.

An inverter 6 including a first electrical switch 7 and a second electrical switch 8 is connected in parallel with the input 2 and with the intermediate circuit capacitor 5. The inverter 6 serves the purpose of providing an AC supply voltage $U_V$, which generally has a frequency which is markedly greater than the frequency of the system voltage.

A control device 9 which can set the frequency of the AC supply voltage $U_V$, namely with corresponding driving of the inverter 6, is provided for driving the inverter 6. The control device 9 is at a first reference potential 10, which is also connected to the second input connection 4 and therefore also represents a reference potential of the inverter 6.

The AC supply voltage $U_V$ is provided between a pole 11, which is arranged between the first and the second switch 7, 8, and the first reference potential 10.

The circuit arrangement 10 includes a resonant circuit 12, which has a resonant inductor 13 and a resonant capacitor 14. The resonant inductor 13 is connected firstly to the pole 11, i.e. to the inverter 6, and secondly to a resonant pole 15. The resonant capacitor 14 is coupled between the resonant pole 15 and the first reference potential 10.

The circuit arrangement 1 includes an output 16, which has a first and a second output connection pair 17, 18. The first output connection pair 17 includes a first and a second connection 17*a*, 17*b*, wherein the second output connection pair 18 likewise has two connections 18*a*, 18*b*. A low-pressure gas discharge lamp 19, which is operated using the circuit arrangement 1, is connected to the output 16.

The first connection 18*a* of the second output connection pair 18 is firstly connected to the first reference potential 10 via a first coupling capacitor 20, i.e. is DC-decoupled from the first reference potential 10 by means of the first coupling capacitor 20. Secondly, the first connection 18*a* of the second output connection pair 18 is connected to the first input connection 3 via a second coupling capacitor 21. The first connection 18*a* of the second output connection pair 18 represents a second reference potential 22 (i.e. so-called "low side" of the gas discharge lamp 19). The two coupling capacitors 20, 21 ensure that it is not possible for any direct currents to flow via the gas discharge lamp 19. Such direct currents could result in a visible inhomogeneity of the light emitted by the gas discharge lamp 19 (cataphoresis). In addition, the symmetrical arrangement of the coupling capacitors 20, 21 provides the advantage that the current loading of the intermediate circuit capacitor 5 is at its lowest.

In order to ensure gentle starting of the gas discharge lamp 19, the electrodes of the lamp 19 first need to be preheated. For this purpose, the circuit arrangement 1 includes a transformer 23 with a primary winding 24, a first secondary winding 25 and a second secondary winding 26. The primary winding 24 is connected in series with the resonant capacitor 14 and is secondly connected directly to the first reference potential 10. The first secondary winding 25 is firstly connected to the first connection 17*a* and secondly connected to the second connection 17*b* of the first output connection pair 17. The second secondary winding 26 is connected firstly to the first connection 18*a* and secondly to the second connection 18*b* of the second output connection pair 18.

An electrical switch 27, whose control connection is coupled to the control device 9, is connected in parallel with the first primary winding 24 of the transformer 23. Thus, this switch 27 can be switched, by the control device 9, between an electrically conducting switching state, in which the primary winding 24 is bridged, and a blocking switching state. The electrical switch 27 can be, for example, a MOSFET, e.g. a MOSFET which does not have a parasitic diode and therefore has a symmetrical design.

The control device 9 is coupled to a pole 28, which is arranged between the resonant capacitor 14 and the primary winding 24, namely via a resistor 29 with a high value resistance. The resistance value of the nonreactive resistor 29 can be, for example, 1 MΩ. By virtue of the connection to the pole 28, the control device 9 can detect an electrical voltage drop across the primary winding 24. The control device 9 can evaluate this voltage and, by virtue of this evaluation, draw conclusions on the operating states prevailing at the output 16. If the impedance at the output 19 changes, whether it be at the first and/or second output connection pair 17 or 18, the voltage drop across the primary winding 24 also changes. By evaluating this change, it is therefore possible for the control device 9 to identify that, for example, a filament of the lamp 19 has burnt through or else whether there is a short circuit between the connections 17*a*, 17*b* and 18*a*, 18*b*. If the voltage across the primary winding 24 is in an impermissible value range during a preheating phase of the electrodes of the lamp 19, the control device 9 can switch off the inverter 6 and therefore disconnect the AC supply voltage $U_V$.

The way in which the circuit arrangement 1 operates will be explained in more detail below:

First, the DC supply voltage $U_G$ is provided, namely by an operator closing a mains switch, for example. If the DC supply voltage $U_G$ is present at the input 2, the control device 9 is also in operation; said control device 9 can generate the AC supply voltage $U_V$ for the gas discharge lamp 19 by driving the inverter 6. Before a preheating phase is initiated, the control device 9 drives the inverter 6 in such a way that very low currents flow via the primary winding 24. This can be achieved by virtue of the fact that the control device 9 sets a frequency of the AC supply voltage $U_V$ which is markedly higher than a preheating frequency and a starting frequency. During the driving, the control device 9 checks whether the electrical voltage drop across the primary winding 24 is in a predetermined value range or not. If it is possible for this to be confirmed, this means that the gas discharge lamp 19 is connected properly to the output 16. If the voltage across the primary winding 24 is in an impermissible value range, the control device 9 switches off the inverter 6, and no voltage is applied to the output 16.

If a predetermined preheating criterion has been met, the control device 9 initiates the preheating phase. In this preheating phase, the electrodes of the gas discharge lamp 19 are heated, namely to a temperature which ensures gentle starting of the gas discharge lamp 19. In this case, the preheating criterion includes the fact that, firstly, the DC operating voltage $U_G$ is provided at the output 2 and secondly that the voltage across the primary winding 28 is in the predetermined value range, during driving of the inverter 6 (low currents across the primary winding 25).

If the preheating criterion has been met, the control device 9 initiates the preheating phase by virtue of the frequency of the AC supply voltage $U_V$ being set to a preheating frequency. During this preheating phase, the AC supply voltage $U_V$ is therefore set in such a way that the gas discharge lamp 29 is not yet started. During the preheating phase, currents which are generated by the transformer 23 flow via the output connection pairs 17, 18 and therefore via the electrodes of the gas discharge lamp 19. These currents heat the electrodes of the lamp 19.

During the preheating phase as well, the control device 9 checks whether the voltage across the primary winding 25 is in a predetermined value range. Once a predetermined starting criterion has been met, the control device 9 concludes the preheating phase and reduces the frequency of the AC supply voltage $U_V$ such that the gas discharge lamp 19 starts. When the lamps 19 start, i.e. when the starting criterion has been met, the control device 9 closes the electrical switch 27, with the result that said electrical switch bridges the primary winding 24.

In this case, the starting criterion includes the fact that the voltage across the primary winding 24 which is detected during the preheating phase is within the predetermined value range and a predetermined time interval after initiation of the preheating phase has elapsed, i.e. the preheating phase has lasted for a predetermined time. This means that the electrodes of the gas discharge lamp 19 are heated to the desired temperature and the lamp 19 can be started gently.

Overall, therefore, the invention provides a circuit arrangement 1 which can be produced in a less expensive manner in comparison with the prior art. That is to say that the circuit arrangement 1 manages without any expensive components, such as a high-voltage switch, a diode and an additional coupling capacitor for the primary winding 24, for example, as are used in the subject matter of document EP 0 748 146 A1. The resonant capacitor 14 therefore also performs the function of a coupling capacitor for the primary winding 24.

Furthermore, it is possible to establish in the described manner on the primary side of the preheating transformer whether the electrodes of the discharge lamp are present or whether the lamp has been connected correctly. It is thus possible to make an additional saving in terms of high-voltage resistors and coupling capacitors and diodes at the secondary windings of the preheating transformer which would otherwise be used.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A circuit arrangement for operating at least one low-pressure gas discharge lamp, the circuit arrangement comprising:

an input comprising a first input connection and a second input connection configured to apply a DC supply voltage;

an output comprising a first output connection pair and a second output connection pair configured to connect the at least one low-pressure gas discharge lamp;

an inverter, which is coupled to the first input connection and the second input connection, configured to provide an AC supply voltage from the DC supply voltage;

a control device configured to drive the inverter and thereby to control the frequency of the AC supply voltage, the control device being configured to initiate a preheating phase once a predetermined preheating criterion has been met, in which preheating phase the inverter is operated at a preheating frequency, and to set the frequency of the AC supply voltage to a starting frequency once a predetermined starting criterion has been met;

a resonant circuit comprising a resonant inductor, whose first connection is coupled to the inverter, and whose second connection is coupled to a resonant pole, and comprising a resonant capacitor, which is coupled between the resonant pole and the reference potential of the control device; and a transformer configured to preheat electrodes of the low-pressure gas discharge lamp, which transformer comprises a primary winding, a first secondary winding, which is coupled to the first output connection pair, and a second secondary winding, which is coupled to the second output connection pair;

wherein the primary winding of the transformer is connected in series with the resonant capacitor and is connected directly to the reference potential of the control device, and an electrical switch is coupled in parallel with the primary winding of the transformer, which switch has a control connection, which is coupled to the control device, the control device further being configured to transfer the electrical switch into its electrically conducting switching state once the starting criterion has been met.

2. The circuit arrangement as claimed in claim 1, wherein the electrical switch is a bidirectionally blocking or conducting semiconductor switch.

3. The circuit arrangement as claimed in claim 2, wherein the electrical switch is a bidirectionally blocking or conducting semiconductor MOSFET.

4. The circuit arrangement as claimed in claim 1, wherein the control device is coupled to a detection pole, which is arranged between the primary winding and the resonant capacitor, and is configured to detect a voltage drop across the primary winding.

5. The circuit arrangement as claimed in claim 4, wherein the control device is configured to drive the inverter prior to the initiation of the preheating phase and to detect the voltage drop across the primary winding during this driving, the preheating criterion including the fact that this voltage is in a predetermined value range.

6. The circuit arrangement as claimed in claim 4, wherein the control device is configured to detect the voltage drop across the primary winding during the preheating phase, the starting criterion including the fact that this voltage is in a predetermined value range.

7. The circuit arrangement as claimed in claim 1, wherein the starting criterion includes the fact that a predetermined time interval has elapsed after initiation of the preheating phase.

8. A method for operating at least one low-pressure gas discharge lamp using a circuit arrangement with an input with a first and a second input connection for applying a DC supply voltage, with an output with a first and a second output connection pair for connecting the at least one low-pressure gas discharge lamp, with an inverter, which is coupled to the first and the second input connection, for providing an AC supply voltage from the DC supply voltage, with a control device, which drives the inverter and which initiates a preheating phase once a predetermined preheating criterion has been met, in which preheating phase the inverter is operated at a preheating frequency, and sets the frequency of the AC supply voltage to a starting frequency once a predetermined starting criterion has been met, with a resonant circuit with a resonant inductor, whose first connection is coupled to the inverter and whose second connection is coupled to a resonant pole, and with a resonant capacitor, which is coupled between the resonant pole and the reference potential of the control device, and with a transformer for preheating electrodes of the low-pressure gas discharge lamp, which transformer comprises a primary winding, a first secondary winding, which is coupled to the first output connection pair, and a second secondary winding, which is coupled to the second output connection pair, the method comprising:

during the preheating phase: conducting an electrical current flowing via the resonant capacitor via the primary winding of the transformer as well, said primary winding being coupled in series with the resonant capacitor, and being connected directly to the reference potential of the control device; and once the starting criterion has been met: transferring an electrical switch into its electrically conducting switching state and thereby bridging the primary winding.

* * * * *